US009375384B2

(12) United States Patent
Webster et al.

(10) Patent No.: US 9,375,384 B2
(45) Date of Patent: Jun. 28, 2016

(54) MEDICATION COMPLIANCE PACKAGE WITH HAND HOLE

(71) Applicant: 62770 Manitoba Ltd., Winnipeg (CA)

(72) Inventors: John L. Webster, Winnipeg (CA); Fiona Webster Mourant, Winnipeg (CA)

(73) Assignee: 62770 Manitoba Ltd, Wpg MB (CA)

( * ) Notice: Subject to any disclaimer, the term of this patent is extended or adjusted under 35 U.S.C. 154(b) by 91 days.

(21) Appl. No.: 14/555,112

(22) Filed: Nov. 26, 2014

(65) Prior Publication Data

US 2016/0143809 A1 May 26, 2016

(51) Int. Cl.

| | |
|---|---|
| ***B65D 83/04*** | (2006.01) |
| ***A61J 1/03*** | (2006.01) |
| ***B65D 75/36*** | (2006.01) |
| ***B65D 73/00*** | (2006.01) |

(52) U.S. Cl.

CPC ..... *A61J 1/035* (2013.01); *B65D 73/0078* (2013.01); *B65D 75/367* (2013.01)

(58) Field of Classification Search

USPC ..... 206/528, 531, 532, 534.1, 534.2, 538, 206/815

See application file for complete search history.

(56) References Cited

U.S. PATENT DOCUMENTS

| | | | | |
|---|---|---|---|---|
| 5,147,035 | A * | 9/1992 | Hartman | B65D 75/366 206/45.23 |
| 6,679,381 | B1 * | 1/2004 | Bush | B65D 43/164 206/531 |
| 2003/0183551 | A1 * | 10/2003 | Hulick | B65D 75/327 206/531 |
| 2009/0095649 | A1 * | 4/2009 | Costa | B65D 83/0463 206/530 |
| 2010/0193536 | A1 * | 8/2010 | Benktzon | A61J 1/035 221/1 |
| 2015/0096920 | A1 * | 4/2015 | Trombley | B65D 75/36 206/531 |
| 2015/0307246 | A1 * | 10/2015 | Patwardhan | B65D 55/02 206/1.5 |

* cited by examiner

*Primary Examiner* — Jacob K Ackun

(74) *Attorney, Agent, or Firm* — Adrian D. Battison; Ade & Company Inc.

(57) ABSTRACT

A medication compliance package includes an outer carrier of card defining a rear panel into which the pockets of a blister sheet are attached and covered by a foil layer. A front panel folds over the rear panel to cover its front face and the pockets. The front panel has a slot shaped opening along the mutual side edge with the rear panel to allow fingers of the hand of the user to extend through the opening, with the front and rear panels in the open position, from the rear face of the front panel to reach around the mutual side edge to the rear face of the rear panel. This simplifies the act of popping the medications out of the blister since the fingers engage the rear of the rear panel and the thumb can be used to apply pressure to the pockets.

18 Claims, 7 Drawing Sheets

MEDICATION COMPLIANCE PACKAGE WITH HAND HOLE

This invention relates to a medication compliance package of the type comprising an outer carrier and a blister insert therefor.

BACKGROUND OF THE INVENTION

Conventionally, the outer carrier of a medication compliance package consists of two stiff sheets of card or plastic material hinged together along one longitudinal edge thereof to form a rear panel with a covering front panel. The rear panel is provided with rows and columns of substantially rectangular cut-outs to receive corresponding pockets formed in a blister insert. The blister sheet of a flexible transparent plastics material is provided with a corresponding number of depressed pockets, when viewed from the rear surface thereof, to receive the medication in the form of pills or capsules. A relatively thin sheet of foil or other sealing material is secured to the structure covering the open bases of the pockets and sealing the medication in place. The pockets of the blister sheet engage through the apertures within the rear panel of the carrier so that the medication for various times of the day and various days of the week is clearly visible in these projecting pockets.

In one example of a manufacturing process which can be used, the carrier card and the blister insert are supplied as separate components of a kit for assembly at a pharmacy. The carrier and blister can be sold in kits of for example 250 carrier cards and 250 blister inserts. The pharmacy which is intended to load the medications for the customer receives the product and assembles with the tools provided to prepare and seal the carrier card and blister insert together.

Because many users of this medication delivery system are elderly or health care providers, there can be ergonomic or strength challenges when attempting to "pop" the solid medications out of the blister pockets.

SUMMARY OF THE INVENTION

It is one object of the present invention to provide an improved medication compliance package which may allow the dispensing of the medications easier for use by person of limited strength.

According to a first aspect of the invention there is provided a medication compliance package for use in dispensing solid medications to patients comprising:

a carrier and a blister insert sheet to be carried within the carrier;

the blister insert sheet comprising a plurality of raised pockets arranged in rows and columns, each of which can be compressed by a digit of a hand of a user to expel the solid medications contained within the pocket through an open mouth of the pocket;

the carrier comprising a generally rectangular front panel with a front face and a rear face and a generally rectangular rear panel with a front face and a rear face;

the front panel and the rear panel being hingedly connected together along one corresponding mutual side edge thereof so that the front and rear panels can be moved between a closed position where the front and rear panels are parallel and overlie for closing a rear face of the front panel over a front face of the rear panel and an open position in which the front panel is moved away from overlaying the rear panel;

the rear panel having a plurality of apertures arranged in rows and columns matching the rows and columns of the blister insert sheet and formed through the rear panel such that the blister insert sheet can be arranged with the raised pockets thereof projecting forwardly of the front face of the rear panel from the apertures of the rear panel;

a frangible layer covering the open mouths of the pockets at the rear face of the rear panel;

the front panel having an opening at or adjacent the mutual side edge with the rear panel;

the opening being shaped and arranged so allow fingers of the hand of the user to extend through the opening, with the front and rear panels in the open position, from the rear face of the front panel to reach around the mutual side edge to the rear face of the rear panel.

Preferably the opening includes a filler portion of the card or other material from which the panels are made which is formed by a perforation line in the front panel at least partly around a full extent of the opening. Thus the user acts to tear out the filler portion from the front panel to define the opening into the front panel. However the opening may be formed during manufacture so as to avoid the user from having to tear out the filler.

When used, preferably the perforation is continuous over an extent thereof to form a tab which is sufficiently long to allow the user to grasp an end of the filler portion to be pulled to tear along the perforation line. Preferably this is arranged at one end of the opening to allow the end portion to form the pull tab.

Preferably the front and rear panels are formed of card as is conventionally used to allow the product to be disposable. However other materials can be used including plastics molded materials.

Preferably the front panel includes an edge strip at the mutual side edge with a first fold line on the side of the edge strip adjacent the front panel and a second fold line on the side of the edge strip adjacent the rear panel allowing the edge strip to stand in the closed position at right angles to the front and rear panels.

Preferably the opening is arranged at the first fold line so that it is immediately adjacent the rear panel. However it can be moved away from the fold line.

Preferably the opening forms an elongate slot extending in a direction longitudinally along the edge of the front panel so that the slot can receive the fingers of a user with larger hands. However the slot is not so large that it interferes with the structure or stability of the card.

Thus in one example the opening has a length extending in a direction longitudinally along the edge of the front panel of at least 3 inches and a width extending in a direction transverse to the edge of the front panel of at least 1 inch. This roughly fits the fingers of the user. However the length and width can be increased without making the slot interfere with the front panel.

Preferably the opening is spaced from top and bottom edges of the front panel and is spaced from a side edge of the front panel remote from the rear panel. That is the opening is contained wholly within the edges of the front panel and allows the front panel to be folded back into place over the pockets to protect the pockets from damage or inadvertent dispensing of the medications therein.

Preferably the opening is substantially immediately adjacent the rear panel so that the opening is sufficiently close to the rear panel to allow the thumb of the user to reach to the rows of pockets while the fingers pass through the hole to the rear face of the rear panel. That is the opening is arranged at a position aligned with the rows of apertures.

Preferably the rear panel is formed from an upper panel at the front face and a lower panel at the rear face bonded together with the blister insert sheet therebetween. In this construction the frangible layer is preferably bonded to the lower panel. However other constructions of the card can be used where the frangible layer, typically a foil, is applied directly to the rear face of the blister insert sheet following which the structure is inserted into the card forming the front and rear panels.

According to a second aspect of the invention there is provided a method of dispensing solid medications comprising:

supplying a medication compliance package comprising:

a carrier and a blister insert sheet to be carried within the carrier;

the blister insert sheet comprising a plurality of raised pockets arranged in rows and columns, each of which can be compressed by a digit of a hand of a user to expel the solid medications contained within the pocket through an open mouth of the pocket;

the carrier comprising a generally rectangular front panel with a front face and a rear face and a generally rectangular rear panel with a front face and a rear face;

the front panel and the rear panel being hingedly connected together along one corresponding mutual side edge thereof so that the front and rear panels can be moved between a closed position where the front and rear panels are parallel and overlie for closing a rear face of the front panel over a front face of the rear panel and an open position in which the front panel is moved away from overlaying the rear panel;

the rear panel having a plurality of apertures arranged in rows and columns matching the rows and columns of the blister insert sheet and formed through the rear panel such that the blister insert sheet has the raised pockets thereof projecting forwardly of the front face of the rear panel from the apertures of the rear panel;

and a frangible layer covering the open mouths of the pockets at the rear face of the rear panel;

forming an opening in the front panel at or adjacent the mutual side edge with the rear panel;

inserting fingers of the hand through the opening, with the front and rear panels in the open position, from the rear face of the front panel to reach around the mutual side edge to the rear face of the rear panel;

and compressing a selected one of the pockets with the thumb to expel the solid medication through the frangible layer.

The arrangement herein this provides a modification to the current compliance card which has a cover on it to protect the medication in it and provide Branding information on the outside cover and space for patient/medication information on the inside. Because many users of this medication delivery system are active elderly or health care providers there can be ergonomic or strength challenges when attempting to "pop" the solid medications out of the blister pockets. By creating a perforated cavity or opening in the front cover, the user has the choice to remove (or not) the filler panel to form the opening allowing them to insert their left hand through the opening simplifying the ergonomics of popping the medications out of the blister since the fingers engage the rear of the rear panel and the thumb can be used to apply pressure to the pockets.

BRIEF DESCRIPTION OF THE DRAWINGS

In the drawings like characters of reference indicate corresponding parts in the different figures.

DETAILED DESCRIPTION

Figure 1:
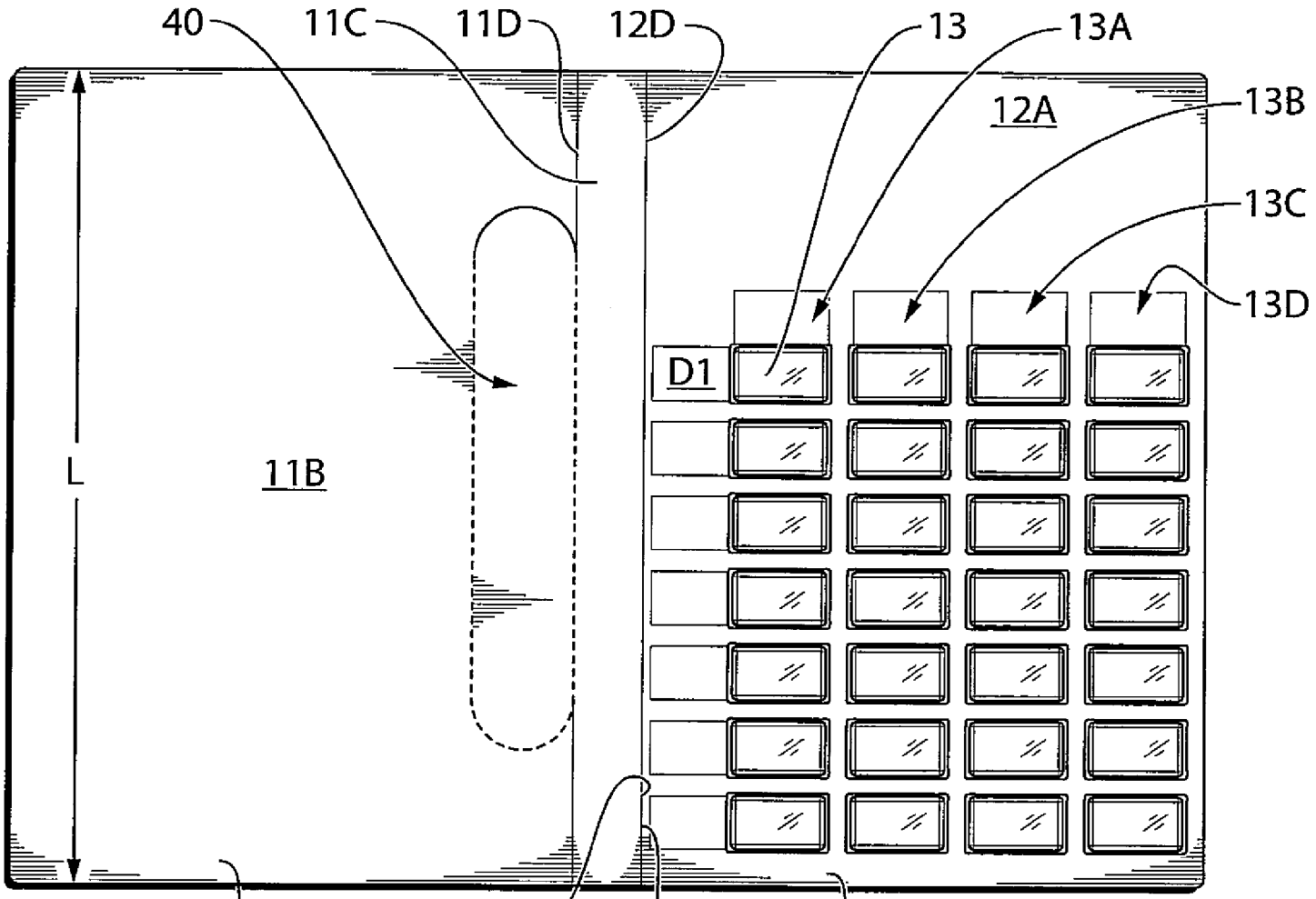
FIG. 1 is a front elevation of the medication compliance card of the present invention.
Figure 2:
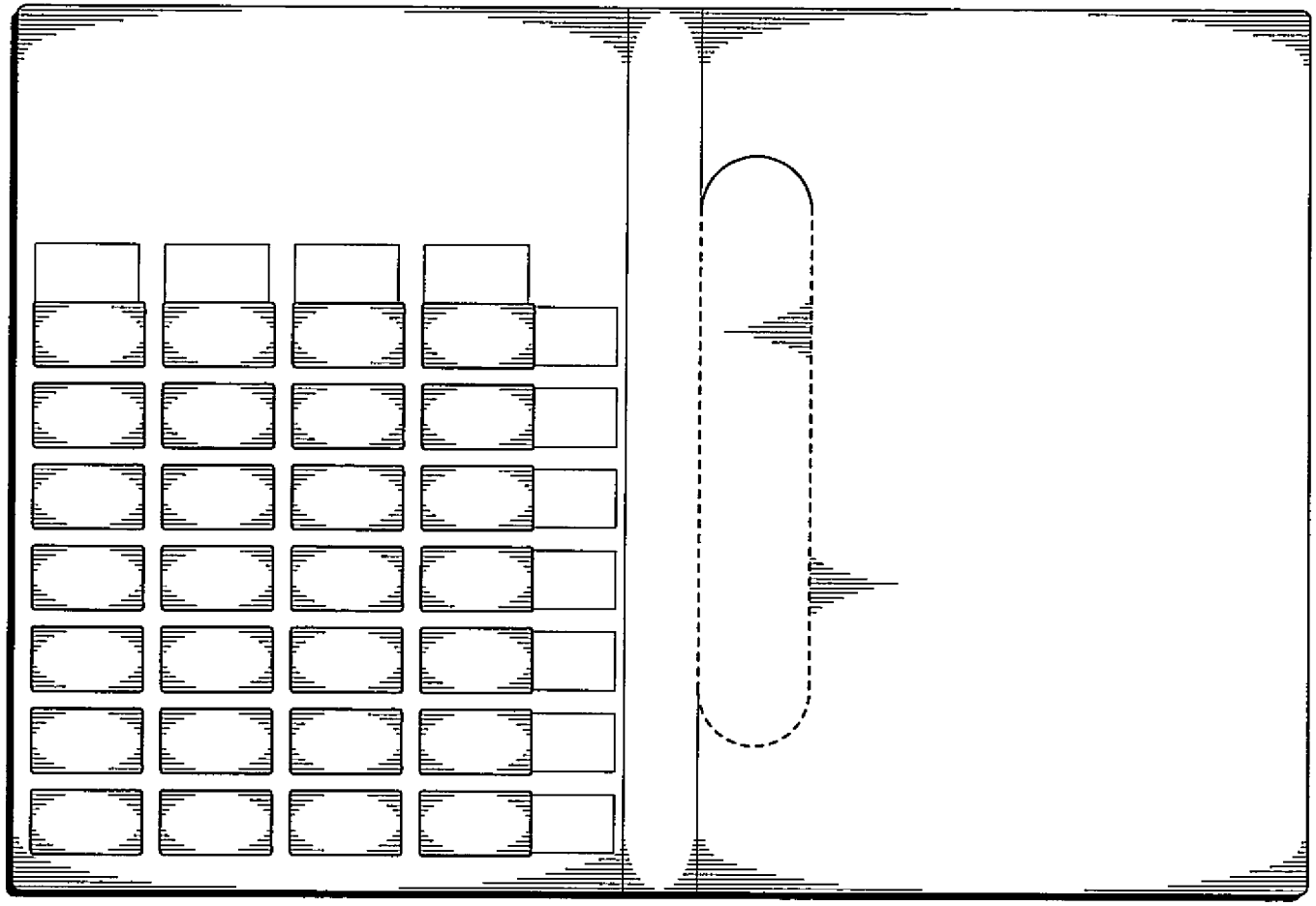
FIG. 2 is a rear elevation of the medication compliance card of FIG. 1.
Figure 3:
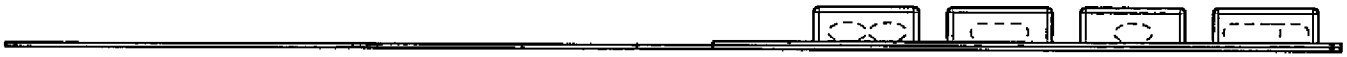
FIG. 3 is a bottom plan view of the medication compliance card of FIG. 1.
Figure 4:
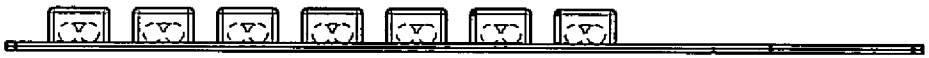
FIG. 4 is a top plan view of the medication compliance card of FIG. 1.
Figure 6:
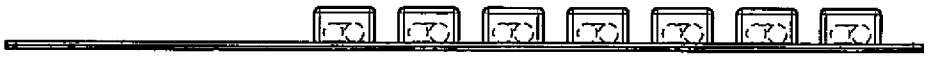
FIG. 6 is a second side elevational view of the medication compliance card of FIG. 1.
Figure 5:
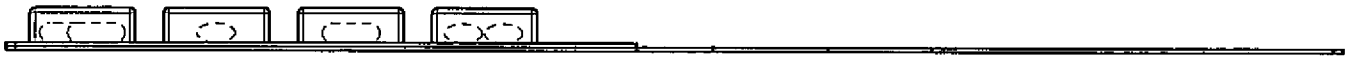
FIG. 5 is a first side elevational view of the medication compliance card of FIG. 1.
Figure 7:
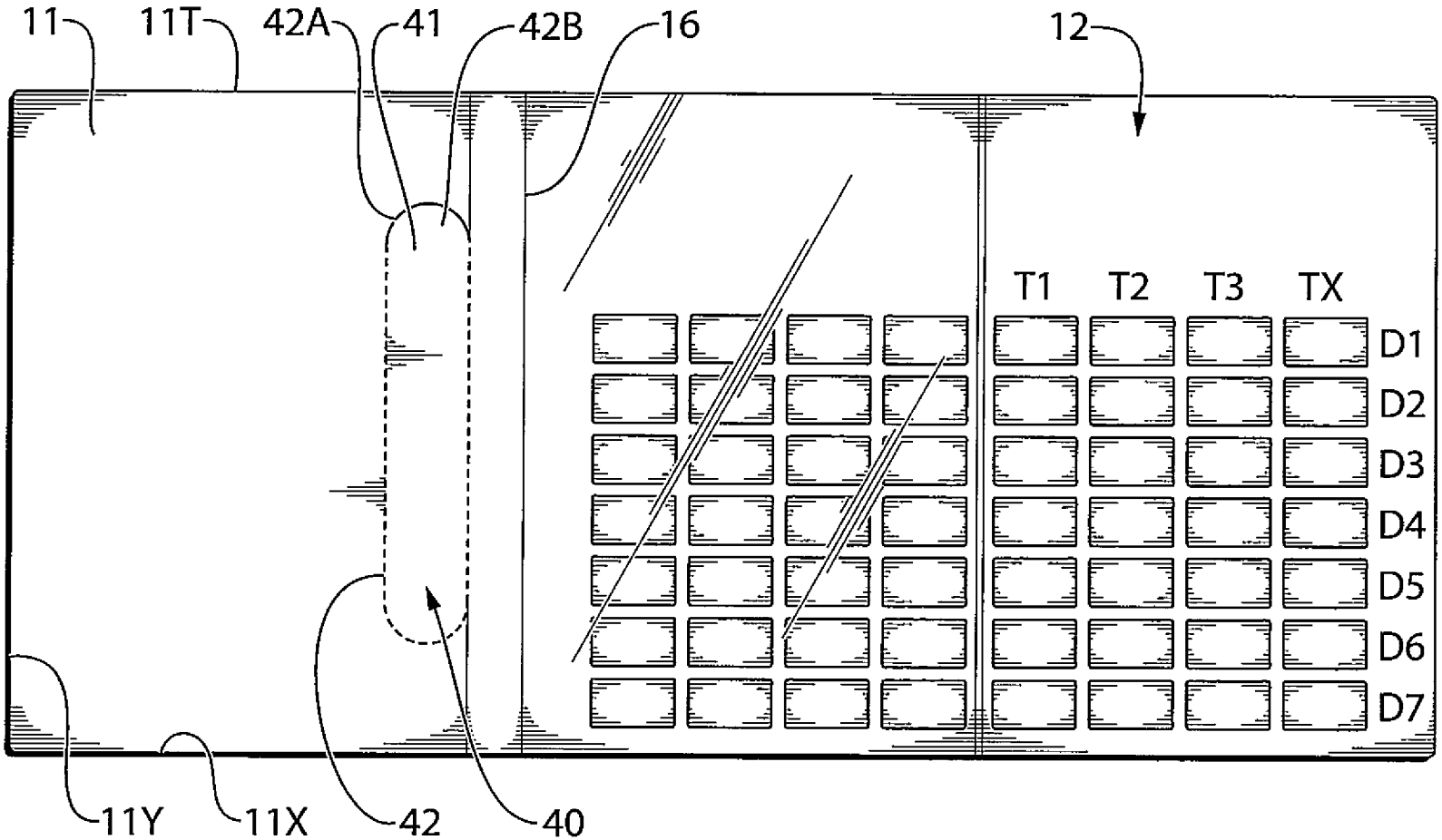
FIG. 7 is a top plan view of the medication compliance card of FIG. 1 in a partly assembled condition.

Proceeding therefore to describe the invention in detail, reference character 10 shows a carrier having a front panel 11 and a rear panel 12 formed of a stiff card material. The rear panel has a plurality of substantially rectangular apertures 13 formed therethrough and in the present embodiment, it will be noted that there are four columns 13A, 13B, 13C and 13D of seven apertures each although of course it will be appreciated that more or less apertures may be provided if desired.

For example, a larger carrier may be provided to carry prepackaged medication for a greater number of days or a smaller carrier for a lesser number of days.

The rear panel 12 of the carrier is similar in rectangular shape and size to the front panel 11 and this rear panel is hinged along one vertical edge 16 to a corresponding vertical edge 17 of the front panel, preferably, by means of a living hinge so that the two panels can be folded open to receive an insert collectively designated 18

The insert collectively designated 18 is made of transparent flexible plastic and of a thinner material than the carrier 10 and is stamped out to provide a plurality of pockets 20 matching the apertures in columns 13A, 13B, 13C and 13D in the rear panel into which the pockets engage when the insert is placed between the two panels of the carrier.

These pockets 20, when first formed in the plastic sheet 18 are open based as at 21 so that medication in the form of pills, capsules or the like 22 may be placed therein whereupon a thin sheet of a frangible material 23 such as foil or the like is adhesively or otherwise secured over the rear side 24 of the insert thus sealing medication within the individual pockets 20.

When medication is required, the relatively thin plastic forming the insert enables the relevant pocket to be pushed downwardly through the corresponding aperture in columns 13A, 13B, 13C or 13D of the front panel thus breaking the frangible foil cover of that particular pocket thereby ejecting the medication through the corresponding aperture in the rear panel and into a small container (not shown) for presentation to the patient.

The various apertures in the columns may be marked by the day of the week vertically and by the times of medication horizontally so that a glance will show the, exact status of the dispensing of medication at any one time.

Against each horizontal column of apertures and preferably on the left hand side of the front panel, there is provided further indicia preferably in the form of a rectangle with an arrowhead indicating the horizontal column and marked successively Sunday, Monday, Tuesday, Wednesday, Thursday, Friday and Saturday. It will therefore be appreciated that both pictorial and written indicia indicate the capsule of pocket of medication which should be taken at each particular time period and it will be appreciated that depression of the flexible transparent material forming the pocket, through the relevant aperture in the rear panel, breaks the foil on the rear side of the insert thus ejecting the medication through the corresponding apertures in the rear panel into a cup or other receptacle.

The medication compliance package as shown in the Figures thus includes the carrier 10 and the blister insert sheet 18 to be carried within the carrier. The blister insert sheet 18 includes the plurality of raised pockets 20 arranged in rows and columns 13A to 13D, each of which can be compressed by a digit of a hand of a user to expel the solid medications contained within the pocket through the open mouth 21 of the pocket.

Figure 10:
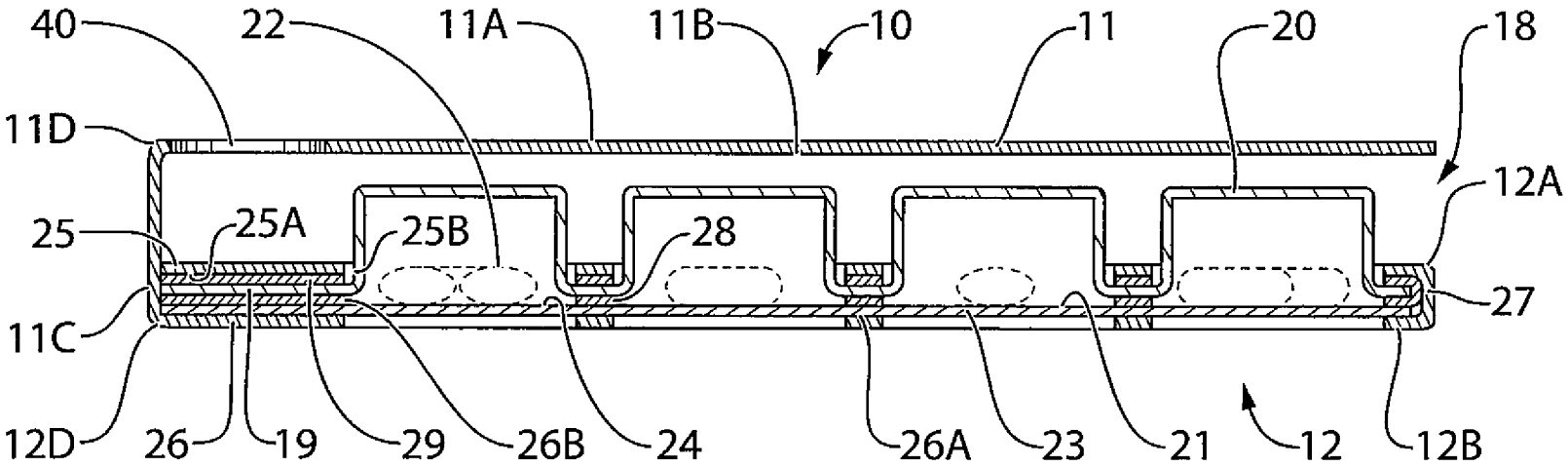
FIG. 10 is a cross-sectional view of the medication compliance card of FIG. 1 in the completed and folded position.

The carrier comprises the generally rectangular front panel 11 with a front face 11A and a rear face 11B and the generally rectangular rear panel 12 with a front face 12A and a rear face 12B. The front panel 11 and the rear panel 12 are hingedly connected together along one corresponding mutual side edge 16, 17 thereof so that the front and rear panels can be moved between a closed position shown in FIG. 10 where the front and rear panels are parallel and overlie for closing the rear face 11B of the front panel over the front face 12A of the rear panel and an open position shown in FIG. 11 in which the front panel 11 is moved away from overlaying the rear panel 12 so as to extend outwardly from the edge 16.

The front panel 11 includes an edge strip 11C at the side edge 17 with a first fold line 11D on the side of the edge strip 11C adjacent the front panel 11 and a second fold line 12D at the edge 16 on the side of the edge strip 11C adjacent the rear panel 12. This allows the edge strip 11C to stand in the closed position at right angles to the front and rear panels 11, 12 in the form of an edge of a book so as to hold the front panel spaced from the rear panel by a distance greater than or equal to the height of the pockets. The edge strip 11C and the front and rear panels are co-extensive in length L.

The rear panel 12 the plurality of apertures 13 arranged in rows and columns matching the rows and columns of the blister insert sheet and formed through the rear panel 12 such that the blister insert sheet 18 can be arranged with the raised pockets 20 thereof projecting forwardly of the front face 12A of the rear panel 12 from the apertures of the rear panel.

The rear panel 12 is formed from an upper panel 25 at the front face 12A and a lower panel 26 at the rear face 12B. The upper panel 25 and the lower panel 26 are hinged together at a fold line 27 at an edge remote from the front panel 11. The upper surface 26A of the lower panel 26 carries a layer of adhesive 28 and the lower surface 25A of the upper panel 25 carries a layer of adhesive 29 so that these layers of adhesive act to bond panels 25 and 26 together with the blister insert sheet 18 therebetween. Each of the panels 25 and 26 has the apertures formed therein so that the apertures overlie when the panels are folded to the overlying position. The adhesive layers 28 and 29 do not of course cover the apertures and thus lie only on the portions of the panels forming the bridges between the apertures. The blister sheet 18 has the pockets 20 and a base sheet 19 between the pockets so that the adhesive layers 28 and 29 cooperate with the base sheet with the pockets 20 free from adhesive. The frangible layer 23 is bonded to the lower panel 26 below the adhesive layer 28.

Figure 8:
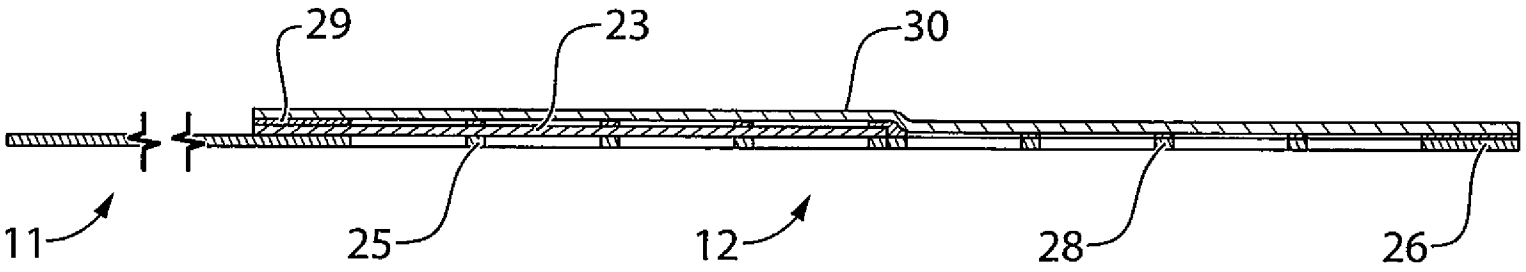
FIG. 8 is a cross-sectional view of the medication compliance card of FIG. 1 prior to application of the blister insert sheet.
Figure 9:
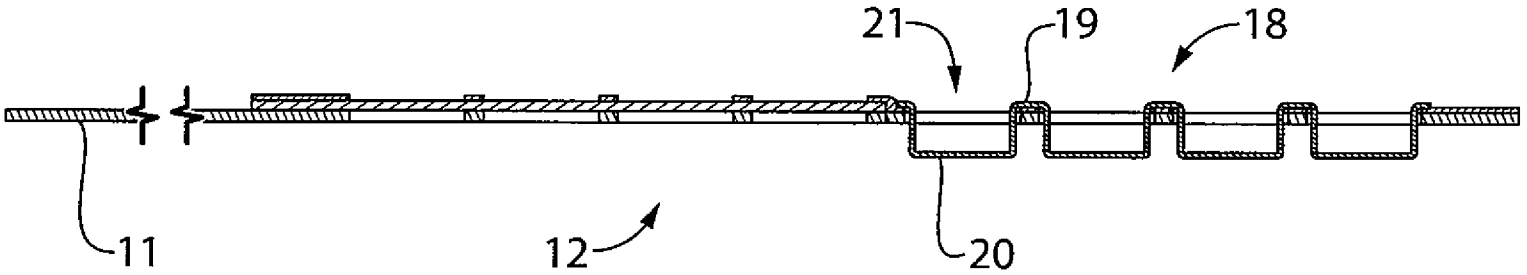
FIG. 9 is a cross-sectional view of the medication compliance card of FIG. 1 after application of the blister insert sheet.

In the manufacturing process shown in FIGS. 8 and 9, the carrier card 10 and the blister insert 18 are supplied as separate components of a kit for assembly at a pharmacy.

The front panel 11 forms a single cover sheet. The rear panel 12 is formed in two parts 25, 26 attached to each other at the hinge 27 to locate the blister insert sheet 18 between the two parts 25, 26. The first part 25 has openings 25B into which the pockets 20 of the blister sheet 18 are inserted. The second part 26 carries the foil layer 23 covering the openings 26B.

As shown in FIG. 9 a release sheet 30 covers the adhesive layers 28 and 29 when the card is supplied. When the panels 25 and 26 are attached together by removing the release sheet 30 and folding at hinge 27, each pocket 20 of the blister sheet 18 is closed by a portion of the foil layer 23 to enclose the solid medications 22 for later release by breaking the foil 23.

The pharmacist or pharmacist technician places the carrier card 10 and blister insert sheet 18 on a platen enabling them to fill the pockets 20 of the blister sheet 18 with the appropriate oral solid medications. They then fold over the first panel 25 and second parts 26 of the rear panel 12 to attach the two parts together to enclose the base layer 19 the blister sheet 18 to hold it in place.

This can be done with cold-seal adhesive 28, 29 applied to both parts and covered with the release sheet 30 as shown. When the release sheet 30 is removed, the two parts 25, 26 are brought together and sealed using a roller to create pressure to seal in the blister sheet 18.

Alternatively in the case of a heat seal card not shown the release sheet can be omitted and the technician requires an electric sealer that heats the card and activates the glue to seal the card.

The sealed product is then provided to a retail customer for use or to a long term care facility or hospital where a health care provider dispenses the medications to the end user.

The frangible layer 23 of the foil covers the open mouths 24 of the pockets 20 at the rear face 12B of the rear panel 12.

Figure 11:
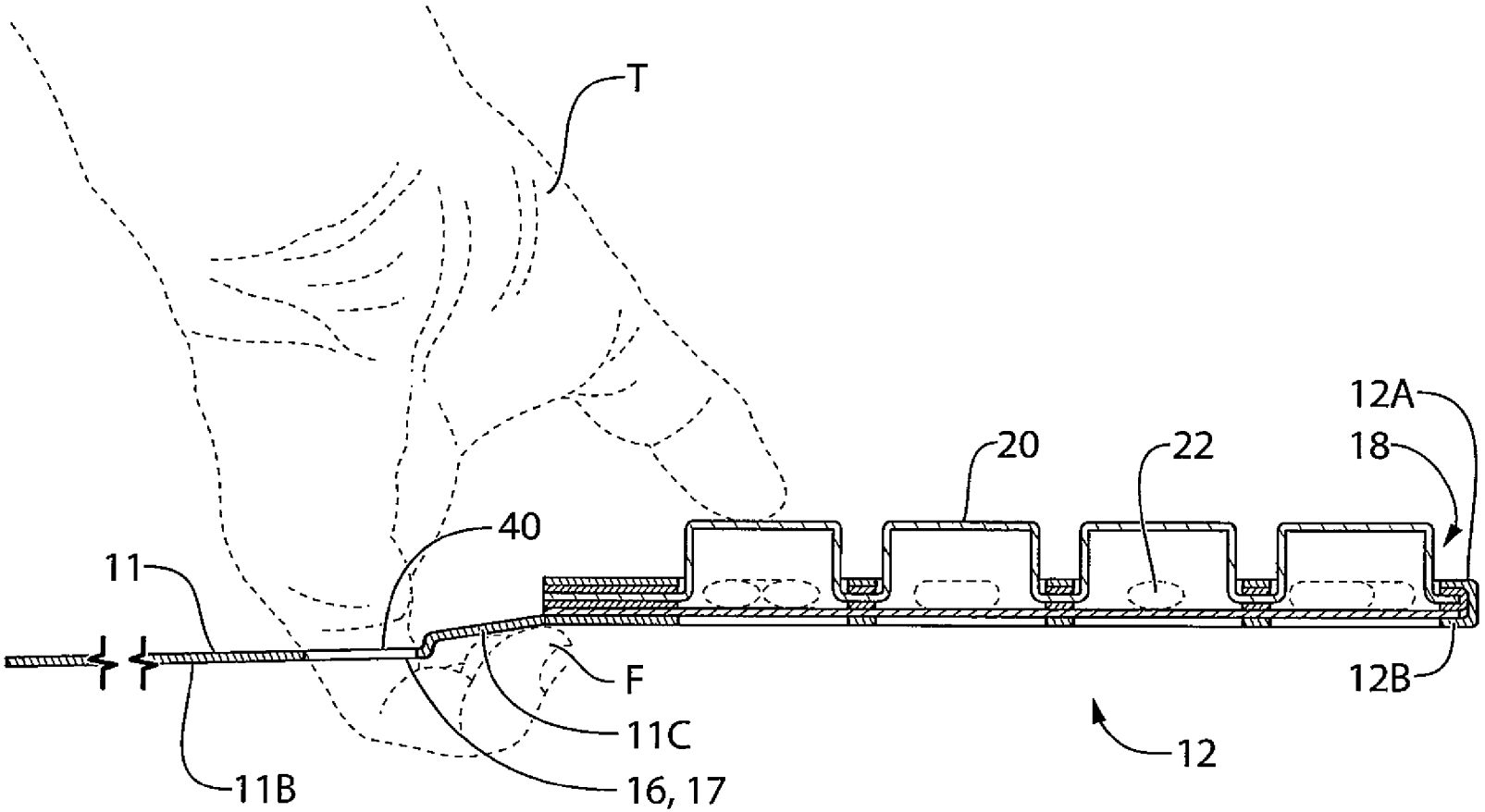
FIG. 11 is a cross-sectional view of the medication compliance card of FIG. 1 in the open position with the hand of the user inserted for dispensing the solid medications.

In the present invention the front panel 11 is provided with an opening 40 at or adjacent the mutual side edge 16, 17 with the rear panel 12. The opening 40 is shaped and arranged so allow fingers F of the hand of the user as shown in FIG. 11 to extend through the opening 40, with the front and rear panels in the open position. The fingers thus extend from the rear face 11B of the front panel 11 to reach around the mutual side edge 16, 17 and past the edge strip 11C to the rear face 12B of the rear panel 12.

When manufactured, the opening 40 includes a filler portion 41 which is formed by a perforation line 42 in the front panel 11 extending around a full extent of the opening 40 allowing the user to tear the filler portion 41 from the front panel 11 to define the opening 40 in the front panel.

The perforation 42 includes an extent 42A thereof which is sufficiently long and located suitably to allow the user to grasp an end 42B of the filler portion to be pulled to tear along the perforation line 42.

The opening 40 is arranged at the first fold line 11D immediately adjacent the edge strip 11C and forms an elongate slot with sides and extending in a direction longitudinally along the edge 16 of the front panel 11. The opening has a length extending in a direction longitudinally along the edge of the front panel of at least 3 inches and possibly as much as 4 inches and a width extending in a direction transverse to the edge of the front panel of at least 1 inch and possibly as much as 2 inches. In this way the opening 40 is spaced from top and bottom edges 11T, 11X of the front panel and is spaced from a side edge 11Y of the front panel remote from the rear panel 12. The opening 40 is symmetrically located in the panel 11 relative to the top and bottom edges or can be located closer to the bottom edge so as to be arranged at a position aligned with the rows of apertures.

The opening 40 is substantially immediately adjacent the rear panel 12 and is sufficiently close to the rear panel 12 to allow the thumb T of the user as shown n FIG. 11 to reach to the rows of pockets 20 allowing them to insert their left hand through the opening simplifying the ergonomics of popping the medications out of the blister since the fingers engage the rear of the rear panel and the thumb can be used to apply pressure to the pockets.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A medication compliance package for use in dispensing solid medications to patients comprising:

a carrier and a blister insert sheet to be carried within the carrier;

the blister insert sheet comprising a plurality of raised pockets arranged in rows and columns, each of which can be compressed by a digit of a hand of a user to expel the solid medications contained within the pocket through an open mouth of the pocket;

the carrier comprising a generally rectangular front panel with a front face and a rear face and a generally rectangular rear panel with a front face and a rear face;

the front panel and the rear panel being hingedly connected together along one corresponding mutual side edge thereof so that the front and rear panels can be moved between a closed position where the front and rear panels are parallel and overlie for closing a rear face of the front panel over a front face of the rear panel and an open position in which the front panel is moved away from overlaying the rear panel;

the rear panel having a plurality of apertures arranged in rows and columns matching the rows and columns of the blister insert sheet and formed through the rear panel such that the blister insert sheet can be arranged with the raised pockets thereof projecting forwardly of the front face of the rear panel from the apertures of the rear panel;

a frangible layer covering the open mouths of the pockets at the rear face of the rear panel;

the front panel having an opening at or adjacent the mutual side edge with the rear panel;

the opening being shaped and arranged so allow fingers of the hand of the user to extend through the opening, with the front and rear panels in the open position, from the rear face of the front panel to reach around the mutual side edge to the rear face of the rear panel.

2. The package according to claim 1 wherein the opening includes a filler portion which is formed by a perforation line in the front panel at least partly around a full extent of the opening allowing the user to tear the filler portion from the front panel to define the opening into the front panel.

3. The package according to claim 1 wherein the perforation includes an extent thereof which is sufficiently long to allow the user to grasp an end of the filler portion to be pulled to tear along the perforation line.

4. The package according to claim 1 wherein the front and rear panels are formed of card.

5. The package according to claim 1 wherein the front panel includes an edge strip at the mutual side edge with a first fold line on the side of the edge strip adjacent the front panel and a second fold line on the side of the edge strip adjacent the rear panel allowing the edge strip to stand in the closed position at right angles to the front and rear panels.

6. The package according to claim 5 wherein the opening is arranged at the first fold line.

7. The package according to claim 1 wherein the opening forms an elongate slot extending in a direction longitudinally along the edge of the front panel.

8. The package according to claim 1 wherein the opening has a length extending in a direction longitudinally along the edge of the front panel of at least 3 inches.

9. The package according to claim 1 wherein the opening has a width extending in a direction transverse to the edge of the front panel of at least 1 inch.

10. The package according to claim 1 wherein the opening is spaced from top and bottom edges of the front panel and is spaced from a side edge of the front panel remote from the rear panel.

11. The package according to claim 1 wherein the opening is substantially immediately adjacent the rear panel.

12. The package according to claim 1 wherein the opening is sufficiently close to the rear panel to allow the thumb of the user to reach to the rows of pockets.

13. The package according to claim 1 wherein the opening is arranged at a position aligned with the rows of apertures.

14. The package according to claim 1 wherein the rear panel is formed from an upper panel at the front face and a lower panel at the rear face bonded together with the blister insert sheet therebetween.

15. The package according to claim 14 wherein the frangible layer is bonded to the lower panel.

16. A method of dispensing solid medications comprising:

supplying a medication compliance package comprising:

a carrier and a blister insert sheet to be carried within the carrier;

the blister insert sheet comprising a plurality of raised pockets arranged in rows and columns, each of which can be compressed by a digit of a hand of a user to expel the solid medications contained within the pocket through an open mouth of the pocket;

the carrier comprising a generally rectangular front panel with a front face and a rear face and a generally rectangular rear panel with a front face and a rear face;

the front panel and the rear panel being hingedly connected together along one corresponding mutual side edge thereof so that the front and rear panels can be moved between a closed position where the front and rear panels are parallel and overlie for closing a rear face of the front panel over a front face of the rear panel and an open position in which the front panel is moved away from overlaying the rear panel;

the rear panel having a plurality of apertures arranged in rows and columns matching the rows and columns of the blister insert sheet and formed through the rear panel such that the blister insert sheet has the raised pockets thereof projecting forwardly of the front face of the rear panel from the apertures of the rear panel;

and a frangible layer covering the open mouths of the pockets at the rear face of the rear panel;

forming an opening in the front panel at or adjacent the mutual side edge with the rear panel;

inserting fingers of the hand through the opening, with the front and rear panels in the open position, from the rear face of the front panel to reach around the mutual side edge to the rear face of the rear panel;

and compressing a selected one of the pockets with the thumb to expel the solid medication through the frangible layer.

17. The method according to claim 16 wherein the opening is formed by a tearing along a perforation line in the front panel.

18. The method according to claim 1 wherein the perforation includes an extent thereof which is sufficiently long to allow the user to grasp an end of a filler portion within the opening to be pulled to tear along the perforation line.

* * * * *